US006257976B1

(12) United States Patent
Richardson, III

(10) Patent No.: US 6,257,976 B1
(45) Date of Patent: Jul. 10, 2001

(54) COVER FOR AN AIR REGISTER

(76) Inventor: Samuel Richardson, III, 202 Bexley La., Piscataway, NJ (US) 08854

( * ) Notice: Subject to any disclaimer, the term of this patent is extended or adjusted under 35 U.S.C. 154(b) by 0 days.

(21) Appl. No.: 09/584,234

(22) Filed: May 31, 2000

(51) Int. Cl.[7] ..... F24F 13/06
(52) U.S. Cl. ..... 454/309; 422/124; 454/328
(58) Field of Search ..... 454/284, 289, 454/290, 309, 328, 332, 337; 422/123, 124; 55/505, 506, 491, 493, 501

(56) References Cited

U.S. PATENT DOCUMENTS 4,604,114 * 8/1986 Ward .
5,525,145 * 6/1996 Hodge ..... 454/309
5,863,310 * 1/1999 Brown et al. ..... 55/491 X
5,947,815 * 9/1999 Danforth ..... 454/289
5,984,776 * 11/1999 Berger ..... 454/290
6,149,698 * 11/2000 Uehara ..... 55/506 X

* cited by examiner

*Primary Examiner*—Harold Joyce
(74) *Attorney, Agent, or Firm*—Ted Masters

(57) ABSTRACT

A cover (20) for an air register (500) includes a first frame (22) having a plurality of first columns (24). A second frame (26) is slidabley received by first frame (22) in drawer-like fashion. A scented pad (28), having a congruent plurality of second columns (32), is inserted in second frame (28) to impart a fragrance when air flows from air register (500).

1 Claim, 4 Drawing Sheets

COVER FOR AN AIR REGISTER

TECHNICAL FIELD

The present invention pertains generally to forced air systems which deliver air to interior spaces through air registers or vents, and in particular to a cover which removably attaches to the air register, and which contains a replaceable scented pad.

BACKGROUND ART

Devices relating to air registers and various attachments thereto, and devices for treating air are well known in the ar. For example, U.S. Pat. No. 1,496,326 shows an air purifier which consists of a deodorant holder which can be hung upon a wall, for instance in a clothes closet. U.S. Pat. No. 4,903,584 illustrates a deodorizing air vent attachment. The device comprises a vent fitting mounting surface and a deodorant holding region supported by the mounting surface. The deodorant holding region is itself ventilated for air dispersal of the deodorant supported in the holding region. U.S. Pat. No. 5,240,487 defines a warm air register filter and scent dispenser. A frame carries a variable flow scent dispenser and supports an air filter. The frame, dispenser and filter are inserted as a unit into a forced air heating and/or cooling system duct adjacent to the duct outlet through a floor or wall register. The scent dispenser is a container for scented air freshening material and has apertures through opposite walls which are disposed traversely to the direction of air flow. U.S. Pat. No. 5,240,653 discloses a house freshener consisting of a basket fitting holding an air filter which is attached directly to the duct covering grill within a room. Various air fresheners and germicidal agents may be retained within a particular basket attached to a grill, as can a charcoal filtering agent, and in one preferred embodiment, a plurality of these baskets may be interconnected to enhance the effectiveness of the invention. U.S. Pat. No. 5,258,051 portrays a scented air filter for use with a forced air handling system. The filter has a pad of air-permeable material held in a bordering frame. The bordering frame has a generally U-shaped cross section with an opposing legs extending a short distance over the edge of the pad of air-permeable material. A scented material is placed in the frame. U.S. Pat. No. 5,314,669 comprises a method an apparatus for dispensing scent into the air. The device includes an inner cylindrical member with vents with a retaining carriage which is capable of housing at least two separate and distinct scented media, and an outer cylindrical member with vents. U.S. Pat. No. 5,368,822 consists of a vent scent adapter having a housing having a front face with vents and a support on a backside for securing the housing to a vent of a blower system. A fragrance block having angular passages is inserted into the housing so that air from the blower system passes through the fragrance block and out through the vents in the housing. U.S. Pat. No. 5,422,078 describes an apparatus for providing a scent. The device includes a reusable holder having a connecting means and a scented card insertable into the holder. The connecting means can be a clip which is connectable to a louver of an air duct outlet register of a forced air system or to a fan guard of a utility fan. U.S. Pat. Nos. 5,547,636 and 5,861,128 include a scented air refreshening device and method of making same. An air freshening device is made from a solution of a polymer and a fragrant material, which is applied to an air permeable substrate. A solid fragrant residue is formed on the substrate. The air freshening device is attached to an air filter in a forced air heating, ventilating, or cooling system. U.S. Pat. No. 5,817,168 depicts an aromatic filter system for an HVAC system. The system has a rectangular frame with a central opening. A conventional filter spans the central opening for interaction with the incoming forced air. A grid spans the filter on the incoming side, the grid presenting a plurality of horizontal and vertical spaced-apart strands having aromatic particle impregnated therein. U.S. Pat. No. 5,820,791 shows a fragrance dispenser for air treatment apparatus. The device is used in conjunction with an air circulation system of a building for impregnating the air with an aromatic scent. The device comprises a combination of integrally mixed plastic with a scent substance formed through a manufacturing process that produces a shape for the device which permits it to be removably attached to an air filter. U.S. Pat. No. 5,863,310 illustrates a grill/filter mounting assembly for mounting in the exit or entrance wall opening of a forced air duct wherein the duct plate may be installed in a hinged relation to the duct enabling easy access to the duct opening.

DISCLOSURE OF INVENTION

The present invention is directed to a cover for an air register of an air conditioning, heating, or ventilation system. The cover includes a scented pad which imparts an aroma or therapeutic fragrance to air blowing through the register. The cover may be retrofitted to any existing air register. A preferred name for the present invention is "SCENT-A-VENT".

The retrofitted cover is designed to work with the existing vent registers in a home or office. The cover can be easily attached directly over an existing (floor, wall or ceiling) vent register by using Velcro™, adhesive, or magnets located on the back of the cover. Once attached the scented cartridge can be placed on the sliding scented filter tray and then closed. Too maximize affects of the present invention, the ventilation system needs to be activated. A user can enjoy the aromatherapy of the present invention when using heating or air-conditioning in the home or office.

Some of the many advantages of the present invention are:

- The Scent-A-Vent Cover System can easily be attached to a floor, ceiling or wall existing vent register magnetically, with an adhesive or with Velcro™.
- The uniquely shaped scented pad is designed to mirror the slits or openings on the face of the cover. This will allow the air to pass through the present invention without interrupting the normal airflow.
- The scented pad or cartridge can be scented with natural oils used in Aroma Therapy products.
- The scented pad can be reused by utilizing drops or sprays. This will extend the life of the scented pad.
- The scented pad can come in regular and hypoallergenic scents.
- The cover has a sliding tray or drawer for easy access when inserting and removing the scented pad.
- The cover also comes in a retrofitted floor design having beveled edges which helps to prevent tripping when walking by or over the cover.
- The present invention is designed to fit any existing ventilation system's register, commercial or residential. It can easily be installed by simply attaching the unit directly over the existing register.

In accordance with a preferred embodiment of the invention, a cover which can be removably attached to the air register of a ventilation system includes a first frame which has a plurality of spaced-apart columns. A second frame resembling a bottomless drawer or tray is slidably received by the first frame. A scented pad or cartridge is removably insertable into the second frame.

In accordance with an important aspect of tine invention, the scented pad also has a plurality of spaced-apart columns which match the pattern of the plurality of columns on the first frame, so that when the scented pad is installed in the second frame, and the second frame is fully inserted into the first frame, the columns of the scented pad align with those of the first frame, thereby minimizing interference with air flow.

In accordance with an important feature of the invention, attachment devices are disposed upon the rear of the cover to permit attachment to the air register.

In accordance with another important aspect of the invention, the second frame may either be entirely removable from the first frame, or the second frame may be captively held by the first frame at an outermost position.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 2:
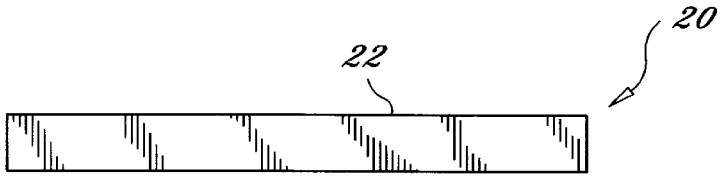
FIG. 2 is a top plan view.
Figure 3:
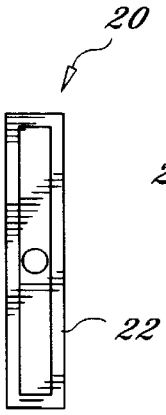
FIG. 3 is a side elevation view.
Figure 1:
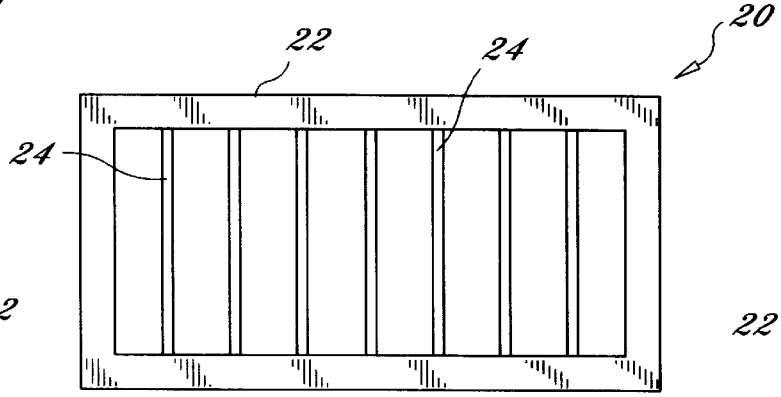
FIG. 1 is a front elevation view of a cover for an air register in accordance with the present invention.
Figure 4:
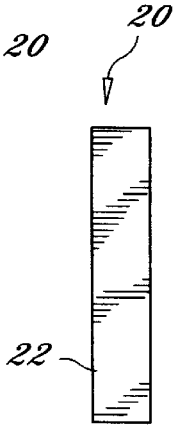
FIG. 4 is an opposite side elevation view.
Figure 5:
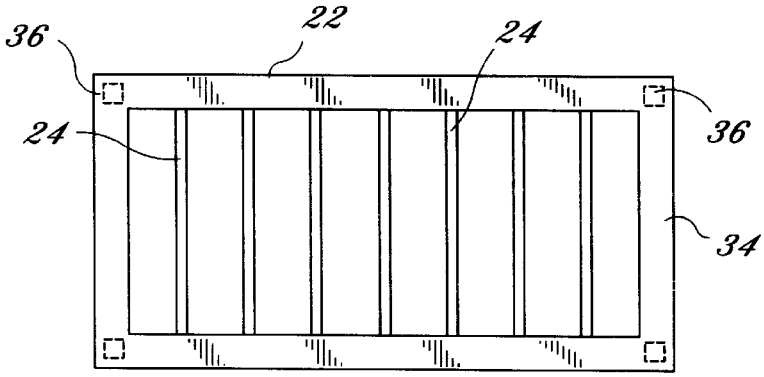
FIG. 5 is a rear elevation view.

Referring initially to FIGS. 1, 2, 3, 4, 5, and 7, there are illustrated front elevation, top plan, side elevation, opposite side elevation, rear elevation, and exploded perspective view respectively of a cover for an air register in accordance with the present invention, generally designated as 20. Cover 20 includes a first frame 22 having a plurality of spaced-apart first columns 24. In a preferred embodiment first columns 24 are sized and spaced to match the vanes 502 of air register 500 which is mounted in a wall, ceiling, or floor 504. A second frame 26 is slidably received by first frame 22 in drawer-like fashion. A scented pad 28 is removably insertable into second frame 26, and rests upon a ledge 30. Also, in a preferred embodiment, first frame 22, second frame 26, and scented pad 28 have a substantially rectangular shape, and cover 20 is shaped and dimensioned to be placed over and cover air register 500.

Scented pad 28 has a plurality of spaced-apart second columns 32 which are congruent with the plurality of first columns 24 of frame 22. So that, when scented pad 28 is inserted into second frame 26, and second frame 26 is slidably inserted into first frame 22, the plurality of second columns 32 substantially align with the plurality of first columns 24. It may be appreciated that while in the shown embodiment first frame 22 and scented pad 28 each have seven columns, any number of columns may be employed.

Cover 22 has a back side 34 having a plurality of attachment devices 36 for attaching cover 22 to air register 500. Attachment devices 36 may include any one of magnets, adhesive, and hook and loop fasteners.

Figure 6:
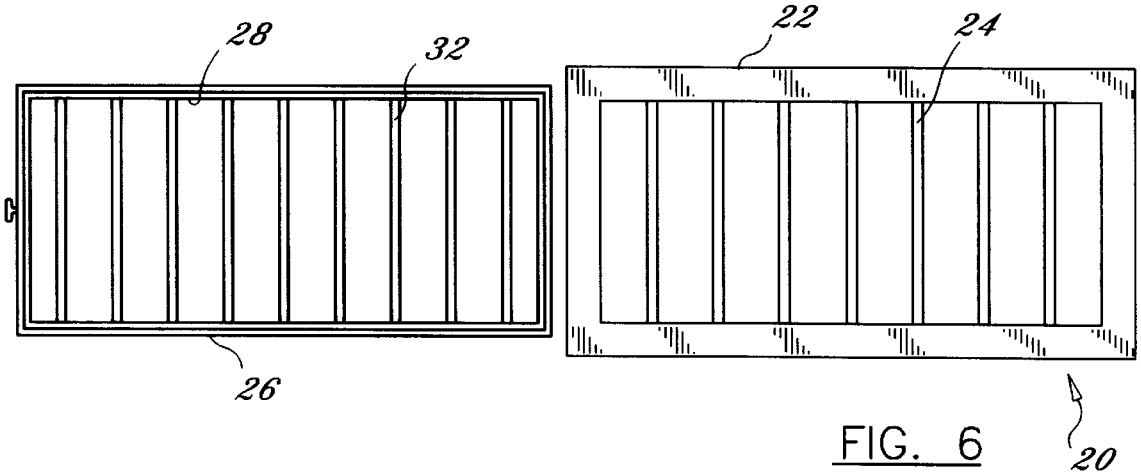
FIG. 6 is a front elevation view showing a second frame removed from a first frame, and a scented pad inserted in the second frame.

Referring now to FIG. 6, there is illustrated a front elevation view showing second frame 26 entirely removed from first frame 22, and scented pad 28 inserted in second frame 26.

Figure 8:
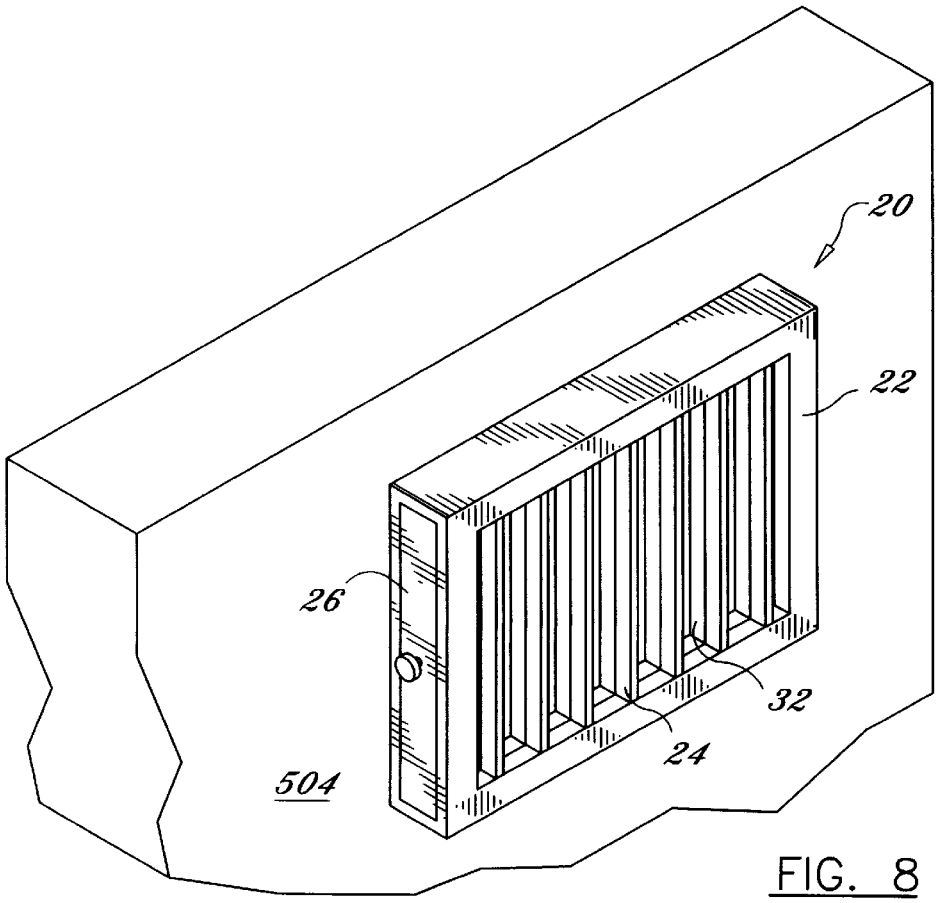
FIG. 8 is a perspective view of the cover of the present invention installed on the air register.
Figure 7:
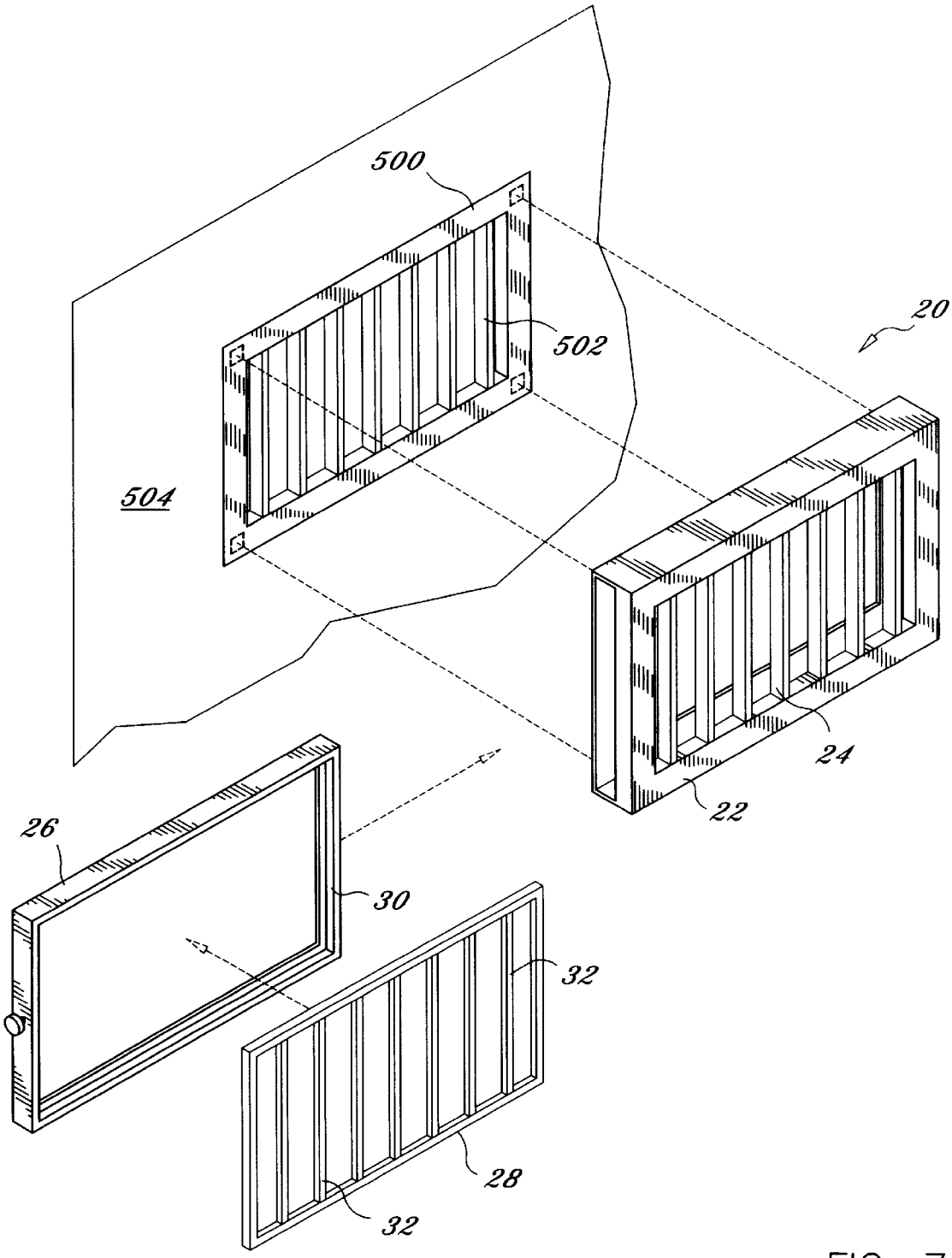
FIG. 7 is an exploded perspective view of an air register, the cover including a first frame, the second frame, and the scented pad.

FIG. 8. is a perspective view of cover 20 of the present invention installed over air register 500.

Figure 9:
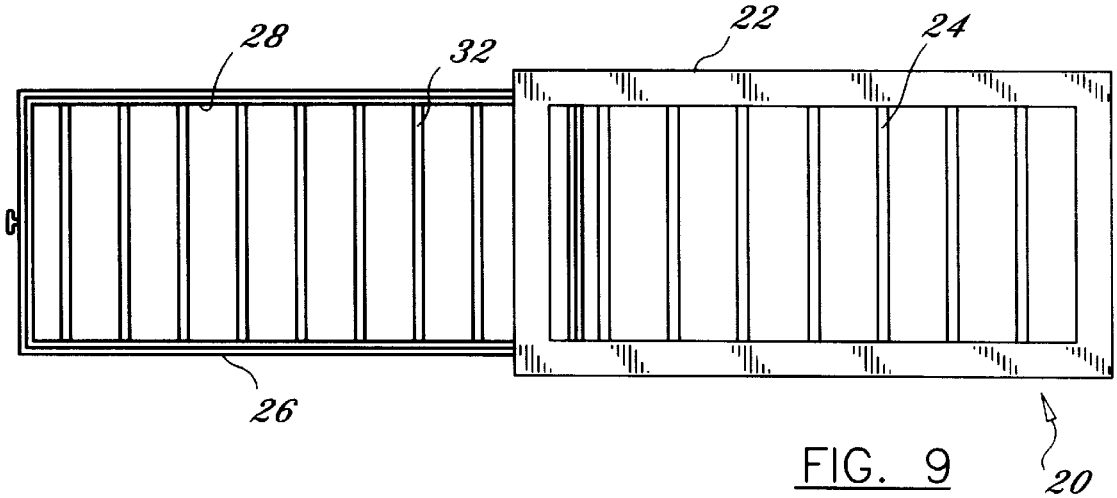
FIG. 9 is a front elevation view of showing the second frame captively held at an outermost position by the first frame; and, FIG. 10 is a perspective view of an embodiment wherein the edges of the cover are beveled.

FIG. 9 is a front elevation view of showing second frame 26 captively held at an outermost position by first frame 22. That is, second frame 26 cannot be totally removed from first frame 22 as was the case in FIG. 6.

Figure 10:
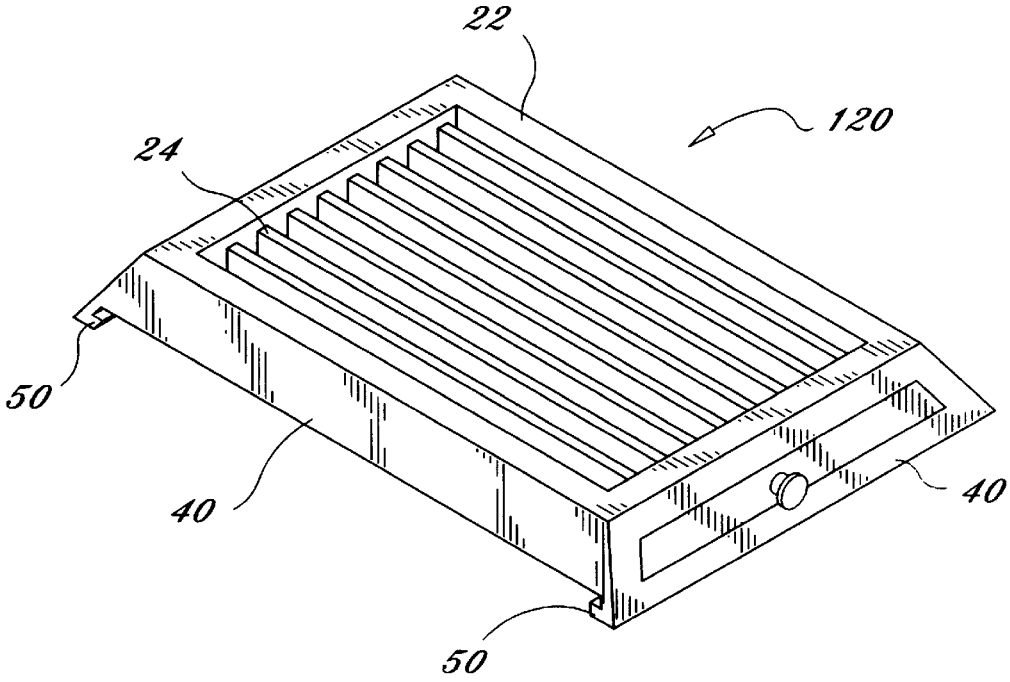

FIG. 10 is a perspective view of a second embodiment, generally designated as 120, wherein the edges 40 of cover 20 are beveled. This embodiment is found useful when cover 20 is placed over a floor air register 500, in that it minimizes abrupt contact by people walking on cover 20. Cover 120 also includes a pair of runners 50 which are used to longitudinally engage air register 500, thereby holding cover 120 firmly in place.

In terms of construction, in a preferred embodiment the present invention will be fabricated from durable plastics that can undergo hot and cold temperature changes. Also, the present invention may be fabricated in a plurality of sizes and shapes to accommodate any type air register.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A cover for an air register, comprising:

a first frame having a plurality of first columns;

a second frame slidably received by said first frame;

a scented pad removably insertable into said second frame;

said scented pad having a plurality of second columns congruent with said plurality of first columns; and, so that when said scented pad is inserted into said second frame, and said second frame is slidably inserted into said first frame, said plurality of second columns substantially align with said plurality of first columns.

* * * * *